United States Patent [19]

Corbin

[11] Patent Number: 4,836,817

[45] Date of Patent: Jun. 6, 1989

[54] FOLDING WING TOY GLIDER

[76] Inventor: Steven K. Corbin, 1617 S. Fremont, Springfield, Mo. 65804

[21] Appl. No.: 187,354

[22] Filed: Apr. 28, 1988

[51] Int. Cl.[4] ..... A63H 27/00; A63H 27/14

[52] U.S. Cl. ..... 446/62; 446/63

[58] Field of Search ..... 446/62, 63, 61, 64, 446/65, 34, 66, 67, 68; 273/426, 427, 428

[56] References Cited

U.S. PATENT DOCUMENTS

| | | | |
|---|---|---|---|
| 1,116,122 | 11/1914 | Reiss | 446/62 |
| 1,842,434 | 1/1932 | Tyrrell | 446/63 X |
| 1,920,746 | 8/1933 | Guillow | 446/62 |
| 1,974,656 | 9/1934 | Nelson | 446/63 X |
| 2,059,131 | 10/1936 | McGall | 446/62 |
| 2,128,747 | 8/1938 | Johnson | 446/62 |
| 2,145,972 | 2/1939 | Clark et al. | 446/62 |
| 2,210,642 | 8/1940 | Thompson | 446/34 |
| 2,236,877 | 4/1941 | Jacobs | 441/62 |
| 2,268,487 | 12/1941 | Jacobs | 446/63 X |
| 2,380,278 | 7/1945 | Weissman | 446/36 X |
| 2,417,267 | 3/1947 | Porter | 446/63 X |
| 2,512,069 | 6/1950 | Mull | 446/62 |
| 3,559,331 | 2/1971 | Eller | 446/74 |
| 3,733,737 | 5/1973 | Goodman | 446/68 |
| 4,292,757 | 10/1981 | Cahen, Jr. | 446/62 |
| 4,324,064 | 4/1982 | Bettencourt et al. | 446/64 |
| 4,388,777 | 6/1983 | Hermann et al. | 446/61 |
| 4,605,183 | 8/1986 | Gabriel | 446/63 |
| 4,742,977 | 5/1988 | Crowell | 244/123 |
| 4,759,736 | 7/1988 | Carlson | 446/62 |

*Primary Examiner*—Mickey Yu
*Assistant Examiner*—D. Neal Muir
*Attorney, Agent, or Firm*—Haverstock, Garrett & Roberts

[57] ABSTRACT

A folding swept wing toy glider having wind sections foldable to a first position wherein the upper surfaces are abutting for launching and biased for deployment at slow speed to a second gliding position wherein the wing sections are substantially coplanar. The wing sections have adjustable trim tabs formed in the trailing edges of the tip portions thereof for flight control adjustments and the glider can be launched by a rubber band launcher.

28 Claims, 2 Drawing Sheets

Fig. 4
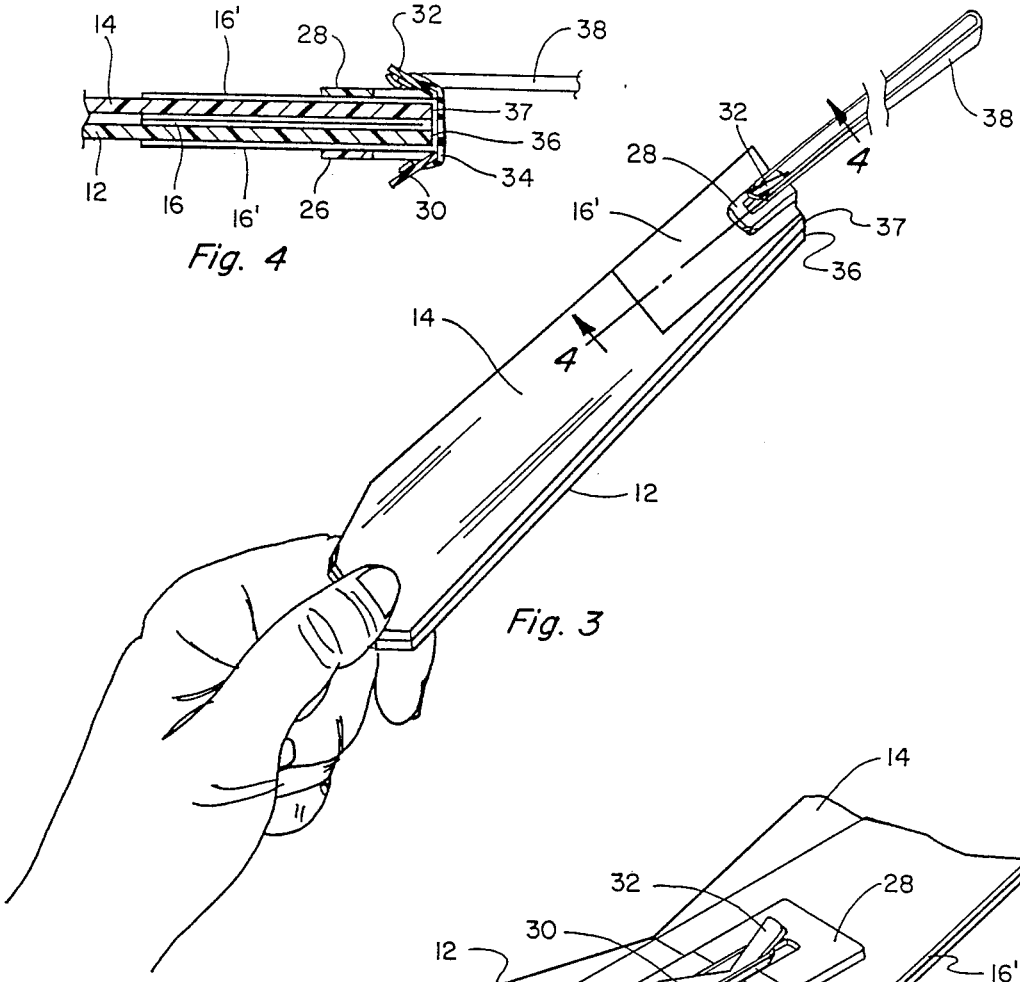
Fig. 3
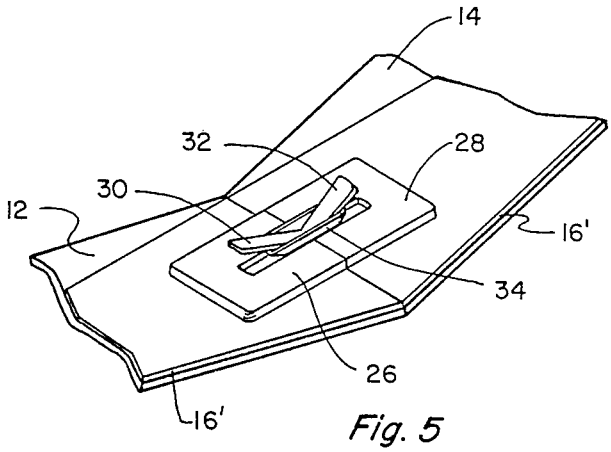
Fig. 5
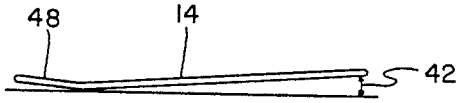
Fig. 7
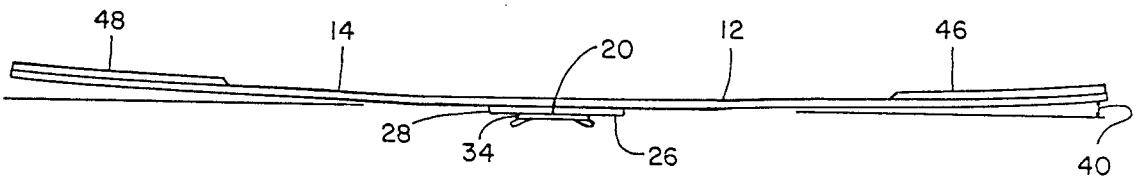
Fig. 6

FOLDING WING TOY GLIDER

The present invention relates to a true "flying wing" toy glider having a configuration that allows it to glide and soar. More particularly, it relates to such a toy glider with respective wing sections deployable after launching for gliding and soaring, and to such a glider having no fuselage or tail section and no horizontal or vertical stabilizers.

BACKGROUND OF THE INVENTION

Several types of toy planes and gliders have been proposed in the past some of which deployed wing sections and entire wing body and tail sections at some point after launching. For example, Reiss, U.S. Pat. No. 1,116,122; Tyrrell, U.S. Pat. No. 1,842,434; Guillow, U.S. Pat. No. 1,920,746; Johnson, U.S. Pat. No. 2,128,747 and Bettencourt et al., U.S. Pat. No. 4,324,064 show such gliders. Others have deployed wing sections horizontally including some with varied degrees of sweep-back, such as shown in McGall, U.S. Pat. No. 2,059,131; Clark et al., U.S. Pat. No. 2,145,972; U.S. Pat. No. 4,292,757 and Gabriel, U.S. Pat. No. 4,605,183. None of these prior designs, however, provides a "true" flying wing construction in which the wing sections are deployed in substantially one plane going from a folded configuration wherein the entire structure is folded with the respective wing section surfaces in abutting contact so as to produce minimum drag upon launching to an open position in which the wing sections are substantially coplanar.

SUMMARY OF THE INVENTION

There are several characteristics which are desired to achieve in a toy glider or sailplane. Among these are: a long glide path for prolonged flights, stability of glide or flight path, ability to pre-set and control the nature of the flight path, i.e. circular or straight, etc., ability to soar when updrafts are encountered, minimum number of control settings, a construction resistant to damage in landings, long lasting construction, relatively economical manufacture as well as other advantages. All of these desirable characteristics and advantages are incorporated to a substantial degree in the present toy glider construction.

Accordingly, it is a principal object of the present invention to provide a glider capable of relatively long gliding and soaring flights.

Another object is to provide a glider that it fun to play with and can be adjusted to provide a wide range of flight characteristics.

Another object is to provide a glider which can be launched manually by a simple rubber band launcher to greater heights than is possible when launching fixed wing gliders using similar launching means.

Another object is to provide a glider having relatively stable flight characteristics.

Another object is to provide a glider whose flight patterns can be readily varied with a minimum of control settings.

Another object is to provide a glider resistant to damage from landings or crashes.

A further object is a glider which is economical to manufacture and to maintain.

Another object is to provide a flying toy which is versatile, low cost, easy to use and can be adjusted to achieve different maneuvers.

Another object is to produce a flying toy which lends itself to being decorated in many different ways to make it attractive to children and others.

These and other objects and advantages of the present invention will be apparent to those skilled in the art upon consideration of the following detailed description in conjunction with the accompanying drawings, wherein:

BRIEF DESCRIPTION OF THE DRAWINGS

FIG. 3 is a perspective view of the present device preparatory to the launching;

FIG. 4 is a cross-sectional view along line 4—4 of FIG. 3;

FIG. 5 is a partial bottom perspective view of the center portion of the device of FIG. 1;

FIG. 6 is a front elevational view of the device of FIG. 1; and

FIG. 7 is a right end view of the device of FIG. 1 showing one way in which the trailing edge of one wing section can be formed.

DESCRIPTION OF THE PREFERRED EMBODIMENTS

Figure 1:
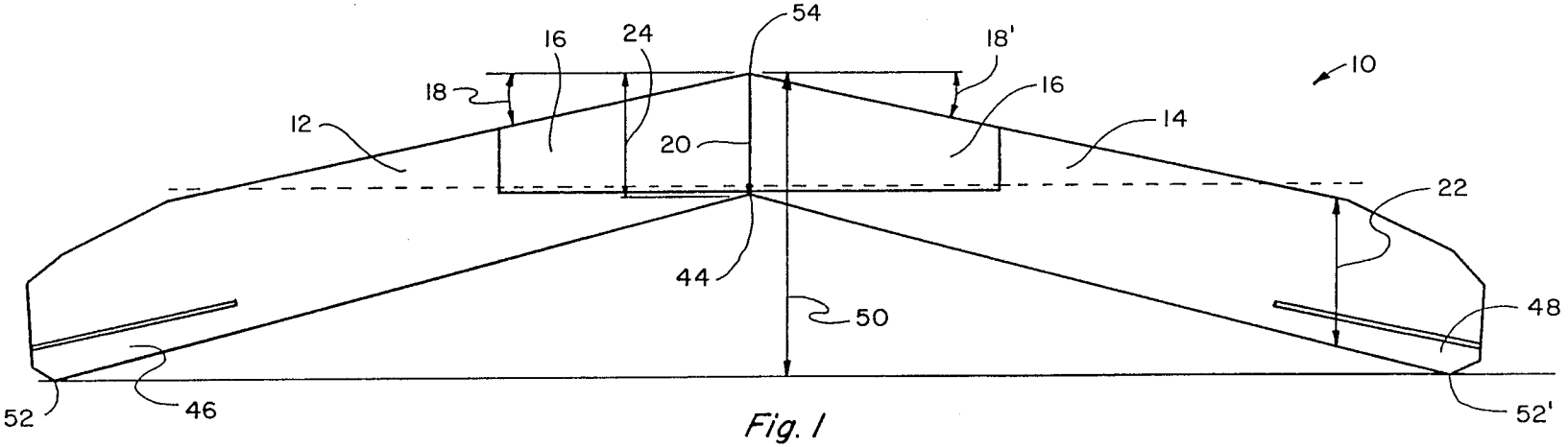
FIG. 1 is a top plan view of one embodiment of the present flying toy device.

Referring to the drawings, more particularly by reference numbers wherein like numerals refer to like parts, in FIG. 1 number 10 identifies one embodiment of the present toy glider formed having two similarly shaped complementary wing sections 12 and 14 hingedly connected together by flexible connecting means 16. Suitable materials to use for the connecting means 16 include lightweight flexible and long lasting materials which can be permanently fixed or bonded to one, and preferably to both, lower and upper surfaces of the respective wing sections 12 and 14. The wing sections 12 and 14 are generally formed of a lightweight expanded or foamed plastic material such as expanded polystyrene, but can also be formed of balsa wood, paperboard or other like materials. Preferably the flexible connecting means 16 will be an adhesive or cement-backed tape which can withstand repeated flexures and still remain strong and intact. Examples of suitable and preferred tape materials for this purpose include adhesive-backed flexible plastic tape of strong and long lasting films such as polyester tape, for example, Mylar film adhesive tape, either metalized or clear, filament-reinforced plastic adhesive tape of the reinforced packaging tape type and fabric adhesive tape such as medical or surgical adhesive tape. Other types of adhesive-backed tapes can also be used with varying degrees of success such, for example, as cellulose film adhesive tape of the library tape type, paper adhesive or gummed tape such as paper packaging tape or unreinforced plastic adhesive packaging tape such as polyvinylchloride or polyethlene adhesive packaging tape. The ability of the tape selected to undergo repeated flexures without damage and the selection of a tape that is strong, weather resistant and lightweight are all desirable characteristics.

The respective wing sections 12 and 14 are connected so as to lie in a swept-back configuration as shown in FIG. 1. The angle of sweep 18 and 18' as measured from a straight line perpendicular to the centerline 20 can be varied from as little as about 12° or even less to as great as about 40°. For best stability in flight such angle is usually selected to be in the range from about 12° to about 18° of sweep. It may also be seen from FIG. 1 that each of the wing sections 12 and 14 is preferably formed with a somewhat longer chord 22 (front to back dimension) at or near the wing tips or ends than the shorter chord 24 located at or near the inner end or root of each of the wing sections. Such a design for the wing sections 12 and 14 is preferred since it serves to contribute to the flight stability of the present glider 10.

Figure 2:
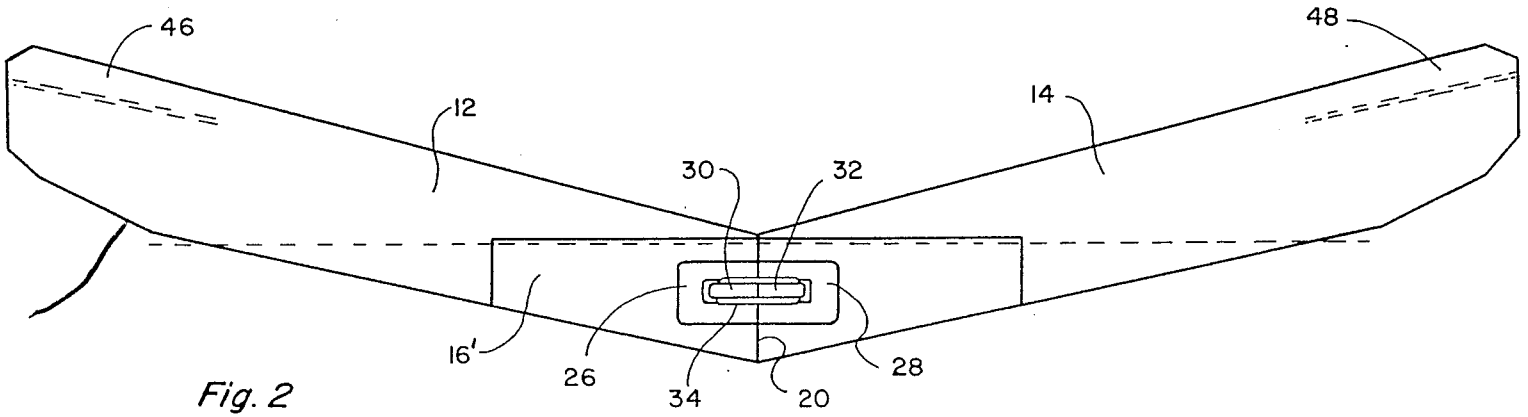
FIG. 2 is a bottom plan view of the device of FIG. 1.

Referring to FIG. 2 in the bottom plan view of the same glider it can be seen the wing sections 12 and 14 have attached to them adjacent to their inner ends 36 and 37 (See FIGS. 4 and 5) block like pieces 26 and 28. The pieces 26 and 28 are formed of molded plastic or the like and each has an outwardly angularly extending tab or hook portion 30 and 32 respectively which hooks are arranged to extend in opposite and outward facing directions from the bottom surfaces of the respective wing sections 12 and 14. An elastic spring or rubber band 34 is positioned extending around the hooks 30 and 32 as more clearly shown in FIG. 5 and is stressed in all orientations of the wing sections in a manner to urge and maintain the wing sections 12 and 14 in substantially coplanar condition which is the condition for flying. The elastic band 34 also enables the wing sections 12 and 14 to be moved to a folded condition as shown in FIG. 3 which is the condition for launching or catapulting the device into the air. In the folded condition the upper wing surfaces of the sections 12 and 14 are in abutting or near abutting surface-to-surface contact. The respective pieces 26 and 28 are preferably formed of a lightweight molded plastic although they could be made of other materials including from thin metal as well as from other materials.

The glider of this invention is intended to be flown by folding the wings to their abutting position and launching it into the air using another rubber band launcher 38 as shown in FIG. 3. The rubber band 38 is usually a somewhat heavier and longer band than the band 34 and, if desired, the band 38 can be attached near one end of a stick or handle (not shown). As long as the speed and hence the airflow along the wing sections 12 and 14 is sufficient to hold them in substantially surface-to-surface contact after launching the glider 10 will have a low drag configuration and the slight additional weight provided by the members 26 and 28 will permit it to reach relatively high altitudes before being slowed to near stopping. When the glider's airspeed is reduced sufficiently during upward travel, the elastic spring 34 is able to open the folded wing sections into their coplanar deployed positions and downward and forward flight will proceed. At this point in the flight sequence the glider 10 assumes the shape of a bodiless, tailless swept-back flying wing glider or sailplane, as shown in FIGS. 1 and 2.

The present invention therefore resides in a toy glider which includes only the configuration of a swept-back wing. The wing design used is inherently stable and does not require any vertical or horizontal stabilizers and hence no fuselage structure as well. The function of a vertical stabilizer is replaced in the present glider by the swept-back configuration of the wing sections 12 and 14. When the airflow becomes angular relative to the centerline 20 of the deployed wing sections, the sweep angles 18 and 18' of the wings become unequal and the wing section with the lesser sweep angle in relation to the relative airflow direction generates the greater drag, while the wing section with the greater sweep angle generates less drag. This imbalance of drag forces about the center of mass of the glider generates a yawing motion that tends to return the glider to a flight attitude where the relative airflow is parallel to the centerline 20 of the deployed wing sections 12 and 14 where the drag forces on the wing sections are essentially equal.

Furthermore, a slight dihedral angle 40, as seen in FIG. 6, which is an optional but preferred feature, may also be incorporated and will tend to generate increased yaw stability. When the relative airflow becomes angular relative to the centerline 20 of the wing sections, the wing sections 12 and 14 will experience an inequality in their respective angles-of-attack 42, i.e. the angle at which the substantially flat wing sections encounter the airflow as shown in FIG. 7. Thus, with the presence of positive dihedral between the wing sections 12 and 14 the advanced wing section with respect to relative airflow will achieve a greater angle-of-attack 42 and the retarded wing section will have a reduced angle-of-attack 42. The increase in angle-of-attack will generate increased drag and increased lift on the advanced wing section while a reduction in angle-of-attack will reduce drag and also lift on the retarded wing section. When the airflow is parallel relative to the centerline 20 of the wing sections 12 and 14 the angles-of-attack 42 will be equal for each wing section as will also be both the drag and lift providing a stable straight flight path.

The preferred dihedral angle 40 may be incorporated in the wing section in several ways. If the wing sections 12 and 14 are constructed of a thin, inherently flexible material such as thin panels of expanded plastic, a desired dihedral angle can be produced in the outer portions of each wing section by adjustment (bending) the edges of the sections to form trim tabs or elevons as shown in FIG. 6 and discussed below. The elevons, or trim tabs, are adjusted to alter the "reflex" or negative camber of the section of wing where they are located. They are intended to be used to trim the glider for the desired angle-of-attack as well as to affect the symmetry of the glider to induce or eliminate a tendency toward curving flight. The trim tabs are not used to alter the dihedral in the usual sense, however if the glider has a built in dihedral angle, and the trim tabs are bent "downward", the glider will tend to assume an inverted flying altitude, and the dihedral will now be "anhedral" or negative dihedral.

Preferably, however, a fixed dihedral angle can be established by forming angled inner edges 36 and 37 on the inner ends of the wing sections where they meet at the centerline 20 in their extended or open condition. Likewise, a fixed dihedral angle for part of the wing sections can be established by forming the respective wing sections to have an upwardly angled outer or tip portion relative to the plane of the respective center portions thereof. Thus, the wing sections can be made to define an angle between their planes of less than 180° so that in flight they are not precisely coplanar. Some down (or up) bending of the rear edges of the wing sections at various locations therealong can also be done to produce different flying conditions as desired. These various ways of producing dehedral angle or forming flaps add substantially to the interest and versatility of the subject glider.

The function of the horizontal stabilizer in a traditional glider or sailplane having a tail section is, at least in part, supplied by the swept-back configuration of the wing sections 12 and 14 and in part by the greater wing chord adjacent to the ends thereof as at the chord 22. The sweep angles 18 and 18' of the deployed and coplanar wing sections 12 and 14 causes the outboard portions of the wing sections to be displaced to some extent rearwardly of the glider's center of mass which is located along the centerline 20 at approximately the point designated 44. Most of the center portions of the wing sections, however, are located forwardly of the center of mass 44, as shown in FIGS. 1 and 2.

The glider of the present invention may include trim tabs 46 and 48 or "elevons" formed by bending the trailing edges of the outboard portions of the wing sections. The trim tabs, can be used as elevators, as ailerons or as both, and thus are referred to as "elevons". In the present glider 10 the elevons 46 and 48 are used to trim and/or modify the glider's flight path during gliding and soaring. The elevons 46 and 48 are usually raised or formed an equal extent to trim the effective angle-of-attack 42. When they are unequal, they operate to cause the glider to follow a curved flight path in a desired direction. The elevons or tabs 46 and 48 function to cause a change in the effective angle-of-attack 42 of the respective wing sections 12 and 14 of which they are a part. For example, raising the trim tab or elevon 48 reduces the effective angle-of-attack 42 of the wing section 14 whereas lowering the trim tab 48 increases the effective angle-of-attack 42 of the wing section 14. Therefore, adjustment of the elevons 46 and 48 can be used to cause the effective angle-of-attack 42 of the outboard portions of the respective wing sections 12 and 14 to be different than that of the center portions of the respective wing sections. The elevons 46 and 48 therefore permit the user to trim out the glider 10 so that the resulting flight path will be either straight or circular as desired.

The glider of the present invention enables use of a unique method for changing its type of flight to suit various flying conditions and the wishes of the operator. Thus, the glider 10 can be flown with either side up or down simply by bending both trim tabs 46 and 48 upward relative to the intended or desired upward facing side of the deployed wing sections. The glider can be provided with a slight dihedral angle 40 wherein the respective wing sections 12 and 14 are not precisely coplanar but form a shallow V shape. Such dihedral angles 40 can, for example, be from a few degrees or less from a condition where the wing sections are at 180° from each other to several degrees or more therefrom. Dihedral angles 40 of from about 1° to 3° upwardly from horizontal for each wing section have been found to produce satisfactory roll stability in flight. Furthermore, such dihedral angles can be either positive or negative sometimes referred to as anhedral. When the glider of the present invention is flown with a positive dihedral angle 40 it will tend to fly in a fairly straight line or describe a flight path of relatively large diameter circles. When flown in such a configuration, the glider will also demonstrate relative insensitivity to asymmetric or different trim settings on the wing sections, i.e. it will demonstrate roll stability. If, on the other hand, the glider 10 is trimmed to fly with a negative dihedral angle 40, or anhedral, the glider will tend to follow an inverted flight path of relatively tight circles, sideslips and wingover maneuvers. Such flight paths will usually result in a shorter total flight time with less total distance covered which may make it preferable when flying in windy or turbulent conditions or in a relatively small space.

It has been found that the present glider flies relatively well in turbulent air conditions and in conditions such as are found on the downwind side of large objects such as buildings and tree lines. The absence of any tail control surfaces substantially reduces the yawing response thereby making the glider's reaction to rapid changes in the direction of the airflow relative to the glider's centerline 20 relatively slow and non-violent when compared to that demonstrated by gliders having tail surfaces.

The subject glider also has a relatively short overall length, that is the distance 50 from a line perpendicular to the centerline 20 between the trailing edges of the respective wing tips 52 and 52' and the point of the nose 54 or point of junction of the leading edges of the wing sections. This short overall front-to-back length 50 reduces the tendency of the glider to stall or dive when encountering changes in relative airflow in a vertical direction. The more conventional types of gliders having fuselages and tail surfaces commonly encounter conditions where the wing portions and the tail surfaces are sometimes in differently vertically moving air and this can cause undesirable stalling and/or diving.

In addition, the glider 10 of the present invention preferably has less of a sweep angle 18 than most pure flying wing type gliders. Therefore, since the glider 10 obtains most of its yaw stability from the sweep angle 18, it is not as damped to yawing as other flying wing types with a higher sweep angle or other designs having a fixed vertical stabilizer. When the present glider is in curving flight, the outside wing tip travels faster than the tip on the inside wing in the curve. Therefore, the outside wing will have greater drag force applied than the inside wing. However, the yawing stability inherent in the present design enables the outside wing section to thereby be retarded, and hence the inside wing section to advance to some extent. This yawing action results in the relative airflow being misaligned with the centerline of the glider and, if the glider is being flown in the configuration having positive dihedral, the inside wing will then have a greater angle of attack than the outside wing. This increased angle of attack will generate increased lift and thereby will act to limit the banking angle of the glider and maintain a stable trimmed flight pattern. The resulting ability of the present device to maintain stable trimmed flight therefore increases the flight time and consequently the distance traversed by the glider 10 during each operation. This in turn adds to the enjoyment of the device in use.

The trim tabs or elevons 46 and 48 can be formed by embossing or pressing a line of indentation into one or both opposite surfaces of the wing sections 12 and 14 in order to make the trim tabs bendable as desired to produce desired flying conditions. Such embossing results in areas of weakening in the wing sections 12 and 14 making it relatively easy to bend the tabs up or down.

As illustrated in FIG. 4, the upper and lower flexible reinforcing tapes 16 and 16' are preferably applied to the upper and lower surfaces respectively of the wing sections 12 and 14. In the case of the upper tape 16, it is applied extending across the centerline 20 holding the sections together therealong and enabling the sections to be moved from their extended condition (FIGS. 1 and 2) to their folded condition (FIGS. 3 and 4). In the case of the flexible tape 16' applied to the lower or underside of the sections 12 and 14 this tape should be applied when the wing sections 12 and 14 are in their folded condition so that part of the tape 16' will extend across the inner end edges 36 and 37 of the wing sections (as shown in FIG. 4). This is done so that the sections will be able to be moved between their two alternative conditions. In this way the tapes 16 and 16' will also touch along a line adjacent to the top of the centerline 20, i.e. substantially along the centerline 20 at the top surfaces of wing sections 12 and 14. The tapes 16 and 16' not only enable the sections to move relative to each other but they also strengthen the sections at their center portion which is an advantage and this makes the center portion somewhat heavier than the rest of the wing sections. The flexible tapes both should also extend equal distances on opposite lateral sides of the centerline 20 to provide a balanced and reinforced construction. It is preferred that the flexible tapes 16 and 16' extend along the respective wing sections well outboard of the outside edges of the pieces 26 and 28 for increased strength and avoidance of the possibility that a wing section might be bent or cracked along such an outside edge. After the tapes 16 and 16' are attached the pieces 26 and 28 are bonded or otherwise fixed to the reinforcing tape 16' on the surface of the respective wing sections 12 and 14 in which the flexible tape 16' extends over the inner edges 36 and 37 of such wing sections as shown in FIGS. 4 and 5. The rubber band 34 is then attached as shown to bias the wing sections 12 and 14 toward open or flying condition, which usually takes place when the glider 10 reaches the top of its flight during launching as described. The subject devices are readily adaptable for packaging in folded condition with the rubber band 34 detached thereby making packaging less cumbersome and less expensive.

It is also contemplated to provide additional trim tabs closer to the centerline 20 for additional trim control if desired. However, such trim tabs have not been found to be as necessary or advantageous as trim tabs 46 and 48 at the outer tip portions of the wing sections and they do not have as much influence on the flying characteristics of the glider.

The glider of the present invention is readily decorated in a variety of ways. The flexible tapes 16 and 16' can also be provided in a wide choice of shapes to provide interest to both the upper and lower surfaces of the wing sections 12 and 14. In addition the flexible tapes can be provided as clear tape, metalized tape or dyed in any desired colors. Tapes of contrasting colors can be used on opposite surfaces or opposite wing sections as desired. Furthermore, decals of any desired designs or colors can also be affixed to the wing sections or supplied with the assembled glider.

Thus, there has been shown and described a novel foldable wing toy glider which fulfills all the objects and advantages sought therefor, including providing a glider capable of relatively long controlled flights displaying stability of glide path. The subject glider also enables the user to preset and control the nature of the flight path to be followed. Therefore, the glider of the present invention is admirably suited for use as a flying toy. It will be apparent to those skilled in the art, however, after reviewing this description and accompanying drawings, that many changes, modifications, variations and other uses and applications for the subject folding wing toy glider in addition to those which have been disclosed are possible and contemplated, and all such changes, modifications, variations and other uses and applications which do not depart from the spirit and scope of the invention are deemed to be covered by the invention which is limited only by the claims which follow.

What is claimed is:

1. A toy glider consisting of a wing assembly comprising two elongated planar wing members each having a length extending from an inner end edge and a tip end, means hingedly connecting the wing members to each other adjacent to the inner end edges thereof for movement between a first position wherein the wing members extend outwardly from the hingedly connected inner end edges in substantially opposite directions and a second launching position wherein the wing members are moved to positions such that the wing member surfaces adjacent the hinged connection are in substantially surface-to-surface relationship over the length thereof, and resilient means bridging the hingedly connecting means urging the wing members toward the first position, said resilient means including a projection attached to each wing member adjacent respective opposite inner end edges of each wing member and a resilient member attached to the projections.

2. The glider of claim 1 wherein the hingedly connecting means includes an adhesive tape member having portions connected to the respective wing members.

3. The glider of claim 1 wherein the wing members form a dihedral angle on one side of the glider that is less than 180° when in the first position.

4. The glider of claim 1 wherein the resilient member includes a rubber band.

5. The glider of claim 1 including means on one of the wing members adjacent to the hingedly connecting means for cooperation with means to catapult the glider into the air along a flight path substantially parallel to the length of the wing members when the wing members are in the second position.

6. The glider of claim 5 wherein the means to catapult the glider into the air includes one of said projections and rubber band means engageable therewith.

7. The glider of claim 1 wherein the wing members are formed of relatively thin lightweight foamed plastic.

8. The glider of claim 1 wherein the projections are formed of molded plastic.

9. The glider of claim 1 wherein each of the wing members has trailing edge portions which can be formed into shapes thereon to produce selected flight characteristics.

10. The glider of claim 9 wherein said trailing edge portions of the wing members include bendable trim tab portions defined by areas of weakness formed in the wing members.

11. The glider of claim 1 wherein the inner end edges of the wing members are angularly oriented such that when the wing members are in their first position the angle formed by and between the planar wing members is less than 180°.

12. The glider of claim 3 wherein the wing members adjacent to the tip ends thereof are formed angularly relative to the plane thereof.

13. The glider of claim 1 wherein the wing members outboard of the hingedly connecting means are flexible to the degree such that they are able to deflect and assume an angle of less than 180° relative to the plane of said wing members adjacent the inner end edges thereof.

14. The glider of claim 1 wherein said wing members are angularly oriented relative to each other whereby the inner end edges of the wing members are forward of the tip ends in the direction of flight.

15. A flying wing toy glider having two swept-back wing sections of elongated planar construction and length each having tip and inner end edges and front and rear side edges and means joining the sections adjacent to the respective inner end edges of the wing sections, said adjoining means including means that allow the wing sections to be moved between an extended substantially coplanar condition to a folded condition wherein the wing sections are in substantially surface-to-surface contact along the length of the surfaces adjacent said joining means, an elastic element and means on the respective wing sections adjacent to the inner end edges thereof for engagement by the elastic element for yieldably urging the wing sections to their extended substantially coplanar condition, and deformable trim tab means adjacent the rear side edge of each of the wing sections, said trim tab means being deformable into positions to produce desired flight control of the glider.

16. The glider of claim 15 wherein the means joining the wing sections include adhesive tape having portions attached to each wing section adjacent to the inner end edges thereof.

17. The glider of claim 15 wherein said elastic element includes a rubber band and the means on the respective wing sections for engagement by the elastic element including a hook attached to each wing section on the surfaces thereof opposite to said joining means.

18. The glider of claim 15 wherein each of said wing sections is wider adjacent to the tip end thereof than adjacent to the inner end edge.

19. The glider of claim 15 wherein said trim tab means are defined in the wing sections by lines of weakness in said wing sections.

20. The glider of claim 15 wherein the extended coplanar condition of the wing sections present a positive dihedral angle therebetween.

21. The glider of claim 14 wherein the extended coplanar condition of the wing sections present a negative dihedral angle therebetween.

22. The glider of claim 20 wherein the dihedral angle is formed at least in part by bending the trim tab means relative to the plane of the respective wing sections.

23. A flying wing toy glider constructed to be catapulted into space which comprises:

a pair of similarly shaped substantially flat elongated swept-back wing sections each having an inner root end, the wing sections adjacent to the root ends being joined by flexible connection means which allows the wing sections to be moved relative to each other between a first position wherein the wing sections are substantially coplanar and a second launching position wherein the surfaces of the wing sections adjacent the flexible connection are in substantially surface-to-surface relationship and the wing sections are in position for catapulting the device into the air, each of said wing sections also having a tip end forming the trailing ends when in launching position during catapulting, each of the wing sections also having front and rear side edges, bendable trim tab means formed along corresponding rear side edges of the respective wing sections, said trim tab means being bendable relative to the plane of the respective wing sections to produce a desired aerodynamic shape for the respective wing sections, and elastic means attached to the respective wing sections on opposite sides of the connection means in position to urge the wing sections toward the first coplanar position thereof.

24. The glider of claim 23 wherein the tip ends of the respective wing sections are located rearwardly of the root ends relative to the direction of forward flight when the wing sections are in the first position, each of said wing sections being wider at a location adjacent to the tip end thereof than adjacent to the root end.

25. The glider of claim 23 wherein the wing sections are formed of an expanded plastic material.

26. A flying wing toy glider adapted to be catapulted into space which comprises:

a pair of similarly shaped substantially flat elongated swept-back wing sections each having a predetermined length and an inner end edge and means connecting the wing sections adjacent to the inner end edges so that the wing sections can be moved angularly relative to each other, said connecting means including flexible tape fixedly attached to the wing sections and extending across and bridging the inner end edges thereof, said wing sections being movable between a substantially coplanar configuration extending outwardly and rearwardly from the inner end edges thereof to a folded condition wherein the wing sections are in alignment and the surfaces thereof adjacent said connecting means are in substantially surface-to-surface contact with each other, bendable trim tab means integral with each wing section bendable to positions relative to the plane thereof to produce a desired flying condition of the wing sections during flight, and elastic means attached to the respective wing surfaces thereof opposite said connecting means yieldably biasing said wing sections toward said coplanar configuration.

27. The glider of claim 26 including means on one of the wing sections adjacent to the inner end edge thereof for cooperating with means to catapult the glider into the air when in the folded condition.

28. The glider of claim 26 wherein said elastic means has portions parallel to the length of the respective wing sections whereby said portions are substantially parallel to the direction in which the glider is catapulted into space when in folded condition.

* * * * *

UNITED STATES PATENT OFFICE

CERTIFICATE OF CORRECTION

Patent No. 4,836,817 Dated June 6, 1989

Inventor(s) Steven Karl Corbin

It is certified that error appears in the above-identified patent and that said Letters Patent is hereby corrected as shown below:

In the Abstract, line 1, "wind" should be --wing--.

Column 1, line 23, after "2,145,972;" insert --Cahen,--.

Column 9, line 38, "14" should be --15--.

Signed and Sealed this

Twentieth Day of February, 1990

*Attest:*

JEFFREY M. SAMUELS

*Attesting Officer* *Acting Commissioner of Patents and Trademarks*